US006641461B2

(12) United States Patent
Wang et al.

(10) Patent No.: US 6,641,461 B2
(45) Date of Patent: Nov. 4, 2003

(54) CHEMICAL MECHANICAL POLISHING APPARATUS HAVING EDGE, CENTER AND ANNULAR ZONE CONTROL OF MATERIAL REMOVAL

(75) Inventors: Huey-Ming Wang, Fremont, CA (US); David A. Hansen, Palo Alto, CA (US); Gerard S. Moloney, Milpitas, CA (US); Jiro Kajiwara, Cupertino, CA (US)

(73) Assignee: Multi Planar Technologyies, Inc., San Jose, CA (US)

( * ) Notice: Subject to any disclaimer, the term of this patent is extended or adjusted under 35 U.S.C. 154(b) by 10 days.

(21) Appl. No.: 09/820,424

(22) Filed: Mar. 28, 2001

(65) Prior Publication Data

US 2002/0173240 A1 Nov. 21, 2002

(51) Int. Cl.[7] ..... B24B 7/19

(52) U.S. Cl. ..... 451/41; 451/285; 451/287; 451/398

(58) Field of Search ..... 451/41, 285, 287, 451/288, 398, 59, 63

(56) References Cited

U.S. PATENT DOCUMENTS 6,083,090 A * 7/2000 Bamba ..... 451/288
6,132,298 A 10/2000 Zuniga et al.
6,162,116 A * 12/2000 Zuniga et al. ..... 451/285
6,210,255 B1 * 4/2001 Zuniga et al. ..... 451/41
6,315,649 B1 * 11/2001 Hu et al. ..... 451/285
6,358,121 B1 * 3/2002 Zuniga ..... 451/41
6,368,191 B1 4/2002 Zuniga et al.

* cited by examiner

*Primary Examiner*—Eileen P. Morgan
(74) *Attorney, Agent, or Firm*—R. Michael Ananian; Dorsey & Whitney LLP

(57) ABSTRACT

An apparatus (100) and method are provided for polishing a substrate (105) that achieves a high-planarization uniformity. In one embodiment, the apparatus (100) includes a subcarrier (165) with a lower surface (170), a flexible member (245) extending across the lower surface, and a control-insert (280) disposed between the flexible member and the lower surface. The flexible member (245) has a surface adapted to press the substrate against a polishing pad. The control-insert (280) inhibits non-planar polishing by providing a variable removal rate across the substrate surface. The control-insert (245) can be an annular ring (280A) located near an outer edge of the flexible member (245) to control the removal rate near an edge of the substrate (105), or a disk (280B) near a center (290) of the flexible member to control the removal rate near a center of the substrate. The removal rate can be further controlled by varying a cross-sectional thickness of the control-insert (245).

27 Claims, 9 Drawing Sheets

CHEMICAL MECHANICAL POLISHING APPARATUS HAVING EDGE, CENTER AND ANNULAR ZONE CONTROL OF MATERIAL REMOVAL

FIELD OF INVENTION

This invention pertains generally to systems and devices for polishing and planarizing substrates, and more particularly to a chemical mechanical planarization or polishing (CMP) apparatus having edge, center and annular zone control of material removal.

BACKGROUND

Chemical Mechanical Planarization or Polishing, commonly referred to as CMP, is a method of planarizing and polishing semiconductor and other types of substrates. Planarizing a surface of a semiconductor substrate or wafer between certain processing steps allows more circuit layers to be built vertically onto a device. As feature size decreases, density increases, and the size of the semiconductor wafer increase, CMP process requirements become more stringent. Substrate to substrate process uniformity as well as uniformity of planarization across the surface of a substrate are important issues from the standpoint of producing semiconductor products at a low cost. Thus, as the size of structures or features on the semiconductor substrate surface have been reduced to smaller and smaller sizes, now typically less than 0.2 microns, the problems associated with non-uniform planarization have increased.

Many reasons are known in the art to contribute to uniformity problems. These include the manner in which pressure is applied to the backside of the substrate during planarization, edge effect or non-uniformities near the edge of the substrate arising from the typically different interaction between the polishing pad at the edge of the substrate as compared to at the central region, and non-uniform deposition of metal and/or oxide layers that might desirably be compensated for by planarizing or adjusting the material removal profile during polishing. Efforts to simultaneously solve these problems have not heretofore been completely successful.

With respect to the nature of the substrate backside polishing pressure, conventional machines typically use hard backed polishing heads to press the substrate against a polishing surface. That is, the polishing heads have a hard receiving surface that presses directly against the backside of the semiconductor substrate. As a result any variation in the receiving surface of the head, or the presence of any material trapped between the substrate and the receiving surface results in a non-uniform application of pressure to the backside of the substrate. Thus, the front surface of the substrate typically does not conform to the polishing surface resulting in planarization non-uniformities. Moreover, such hard backed head designs often must utilize a relatively high polishing pressure (for example, pressures in the range of between about 6 psi and about 8 psi) to provide any reasonable degree of conformity between the substrate and the polishing surface. However, such relatively high pressures can deform the substrate causing too much material to be removed from some areas of the substrate and too little material from others.

Attempts have been made to remedy the above problems with hard backed polishing heads by providing a soft insert between the receiving surface and the substrate to be polished in an attempt to provide some flexibility in an otherwise hard backed system. This insert is commonly referred to as a wafer insert or more simply an insert. The use of inserts is problematic because they frequently result in process variation leading to substrate-to-substrate variation. This variation is not constant or generally deterministic. One element of the variation is the absorption of water or other fluids such as slurry used in the polishing process. Because the amount of water absorbed by the insert tends to increase over its lifetime, there is frequently process variation from substrate-to-substrate. These process variations may be controlled to a limited extent by preconditioning the insert by soaking the insert in water prior to use and by replacing the insert before its characteristics change beyond acceptable limits. This tends to make the initial period of use more like the later period of use, however, this can increase equipment maintenance costs and decrease process throughput. Moreover, unacceptable process variations are still observed due to, for example, variations in the thickness of the insert, wrinkling of the insert and material being trapped between the hard backed head and the insert or the insert and the substrate.

Moreover, use of inserts also requires a fine control of the entire surface to which the insert is adhered as any non-uniformity, imperfection, or deviation from planarity or parallelism of the head surface would typically be manifested as planarization variations across the substrate surface. For example, in conventional heads, an aluminum or ceramic plate is fabricated, then lapped and polished before installation in the head. Such a complex manufacturing process increases the costs of the head and of the machine, particularly if multiple heads are provided.

To overcome the above problems with hard backed polishing head and polishing heads, some attempts have been made in recent years to utilize soft backed heads, however, they have not been entirely satisfactory. One type of soft backed head is described in U.S. Pat. No. 6,019,671, to Shendon, hereby incorporated by reference. Referring to FIG. 1, a prior art soft backed polishing head 10 typically includes a carrier 12 having a subcarrier 14 with a lower surface 16 on which the substrate 18 is held during the polishing operation, and a retaining ring 20 circumferentially disposed about a portion of the subcarrier. The subcarrier 14 and the retaining ring 20, via a backing ring 22, are suspended from the carrier 12 by a flexible gasket 24 so that they can move vertically and are able to float on the polishing surface (not shown) during the polishing operation. Small mechanical tolerances are provided between the subcarrier 14 and the retaining ring 20 and adjacent elements to accommodate minor angular variations during the polishing operation with little friction and no binding. During the polishing operation a pressurized fluid is admitted into chambers 26, 28, formed by the flexible gasket 24 and the carrier 12 to force the subcarrier 14 and the retaining ring 20 against a polishing surface (not shown). A flexible member 30 or membrane stretched across the lower surface 16 of the subcarrier 14 forms a lower chamber 32 or cavity which is pressurized via a passageway 34 to further press the substrate 18 against the polishing surface.

A primary advantage of a soft backed polishing head 10 lies in the fact that the soft material of the flexible member does not distort the substrate as it is pressed against the polishing pad. As a result, conformity of the substrate front surface to the polishing pad can be achieved at lower polishing pressures and without distortion, providing both improved polishing uniformity and planarization.

While a significant improvement over hard backed heads with or without inserts, prior art soft backed polishing heads are not wholly satisfactory for a number of reasons. One problem with this approach is that it does nothing to reduce or eliminate the non-uniformities due to material trapped between the flexible member and the substrate. Moreover, the use of the flexible member can actually increase non-uniformities by introducing new variables, such as variation in the thickness or flexibility of the flexible member across its surface and possible wrinkling of an improperly installed flexible member.

Another problem with prior art soft backed polishing head is a reduction in polishing performance due to interference by the flexible member with other components of the polishing head. For example, as shown in FIG. 1, during the polishing operation a side or skirt portion 36 of the flexible member 30 can deform or bow out due to the pressure applied to the lower chamber 32. This deformation can reduce or eliminate altogether the small mechanical tolerances provided between the subcarrier 14 and the retaining ring 20, causing friction and binding during the polishing operation. As a result, the polishing head becomes unable to accommodate minor angular variations during the polishing operation, resulting in non-uniformity and poor planarization.

With respect to the desirability of being able to adjust the material removal profile to allow for incoming substrate non-uniform depositions, few if any attempts have been made to provide a machine that affords such compensation. Non-uniform depositions can arise from the structure of circuits formed on the substrate or from characteristics of the deposited layers. For example, copper layers, which have become increasingly common in high-speed integrated circuits, tend to form a convex layer thicker at the center of the substrate than the edge. Thus, it would be desirable to have a polishing apparatus that provided a higher removal rate near the center of the substrate than at the edge.

Therefore, there remains a need for an apparatus that provides excellent planarization, controls edge planarization effects, and permits adjustment the substrate material removal profile to compensate for non-uniform deposition of layers on the substrate.

SUMMARY

The present invention relates to a CMP apparatus and method for polishing and planarizing substrates that achieves a high-planarization uniformity across the surface of the substrate.

According to one aspect of the present invention, a polishing head is provided for positioning a substrate on a polishing surface of a polishing apparatus for processing the substrate to remove material therefrom. The polishing head includes a subcarrier adapted to hold the substrate during a polishing operation, the subcarrier having a lower surface, a flexible membrane or member secured to the subcarrier and extending across the lower surface, the flexible member having a receiving surface adapted to engage the substrate to press the substrate against the polishing surface, and at least one control-insert disposed between the flexible member and the lower surface. During the polishing operation a pressurized fluid is admitted to a chamber between the flexible member and the lower surface to force the substrate against the polishing surface. The control-insert can be attached to either the lower surface of the subcarrier, or to an inner surface of the flexible member. The control-insert is adapted to inhibit non-planar polishing of the substrate surface, by providing a variable removal rate across the substrate surface. The control-insert accomplishes this by providing mechanical force or pressure at various locations across the substrate in addition to that provided by the pressurized fluid.

In one embodiment, the control-insert includes an annular ring. The annular ring can be located near an outer circumferential edge of the flexible member to control a removal rate near an outer circumferential edge of the substrate surface. Alternatively, the annular ring may be between an outer circumferential edge of the flexible member and a center of the flexible member to control the removal rate near an annular middle portion of the substrate surface between an outer circumferential edge of the substrate surface and a center of the substrate surface. It will be appreciated that the control-insert can include multiple annular rings, or a disk and at least one annular ring.

In another embodiment, the control-insert includes a disk near a center of the flexible member to control the removal rate near a center of the substrate surface.

In yet another embodiment, the rate of removal of material across the substrate surface can be further controlled by varying a cross-sectional thickness of the control-insert. In one version of this embodiment, the control-insert has a cross-sectional area with a constant thickness. In other versions, the control-insert can have a thickness that continuously, in a linear or non-linear manner, increases or decreases from a point proximal to a center of the flexible member to an outer circumferential edge of the control-insert. In yet another version of this embodiment, the control-insert can have a thickness that first increases in a radial direction in a first region from a point proximal to a center of the flexible member, and then decreases in a second region from the first region to an outer circumferential edge of the control-insert. Alternatively, the thickness of the control-insert can decrease in the first region, and increases in the second region. It will be appreciated that the above variations in cross-sectional thickness can be used with both annular ring and disk shaped control-inserts.

The control-insert can be made of either a metal or a polymeric material. In one embodiment, the control-insert is made of substantially the same polymeric material as the flexible member, and is integrally formed with the flexible member. Alternatively, both the subcarrier and the control-insert are made of metal, the control-insert is integrally formed with the subcarrier.

In still another embodiment, the subcarrier further includes a passageway in communication with the lower surface for providing a pressurized fluid to the chamber, and the flexible member has a thickness having a number of holes extending therethrough to the receiving surface for applying the pressurized fluid directly to the substrate. In one version of this embodiment, in which the control-insert includes an annular ring, it is located in a position relative to the holes to enable the pressurized fluid to be applied directly to the substrate. In an alternative version in which the control-insert is a disk it also has a number of holes positioned relative to those in the flexible member to enable the pressurized fluid to be applied directly to the substrate.

In another aspect the present invention is directed to a polishing head having a support assembly disposed between the flexible member and the lower surface of the subcarrier, the support assembly adapted to attach the flexible member to the lower surface of the subcarrier and to hold the flexible member spaced apart therefrom. In one embodiment, the flexible member has a receiving surface portion with a receiving surface adapted to engage the substrate to press the substrate against the polishing surface during a polishing operation, and a skirt portion disposed circumferentially about the support assembly. Generally, the skirt portion includes a material having a hardness different from that of the receiving surface portion.

Desirably, the skirt portion includes a hardness greater than that of the receiving surface portion. This is desirable where the polishing head, further includes a carrier and a retaining ring, the carrier adapted to carry the subcarrier, the retaining ring circumferentially disposed about the subcarrier. In this embodiment, the skirt portion should be sufficiently hard to prevent the skirt portion of the flexible member from deforming during the polishing operation and touching the retaining ring. Preferably, the skirt portion has a hardness at least about 50% higher than the receiving surface portion. More preferably, the where receiving surface portion has a Durometer of from about 30A to about 60A, and the skirt portion has a Durometer of from about 60A to about 90A. Most preferably, where the receiving surface portion has a hardness with a Durometer of less than about 50A, the skirt portion has a hardness with a Durometer of at least about 70A.

BRIEF DESCRIPTION OF THE DRAWINGS

These and various other features and advantages of the present invention will be apparent upon reading of the following detailed description in conjunction with the accompanying drawings, where.

DETAILED DESCRIPTION

An improved method and apparatus for polishing or planarization of substrates are provided. In the following description numerous embodiments are set forth including specific details such as specific structures, arrangement, materials, shapes etc. It will be appreciated, however, by one skilled in the art that the present invention may be practiced without these specific details, and the method and apparatus of the present invention is not so limited.

Figure 1:
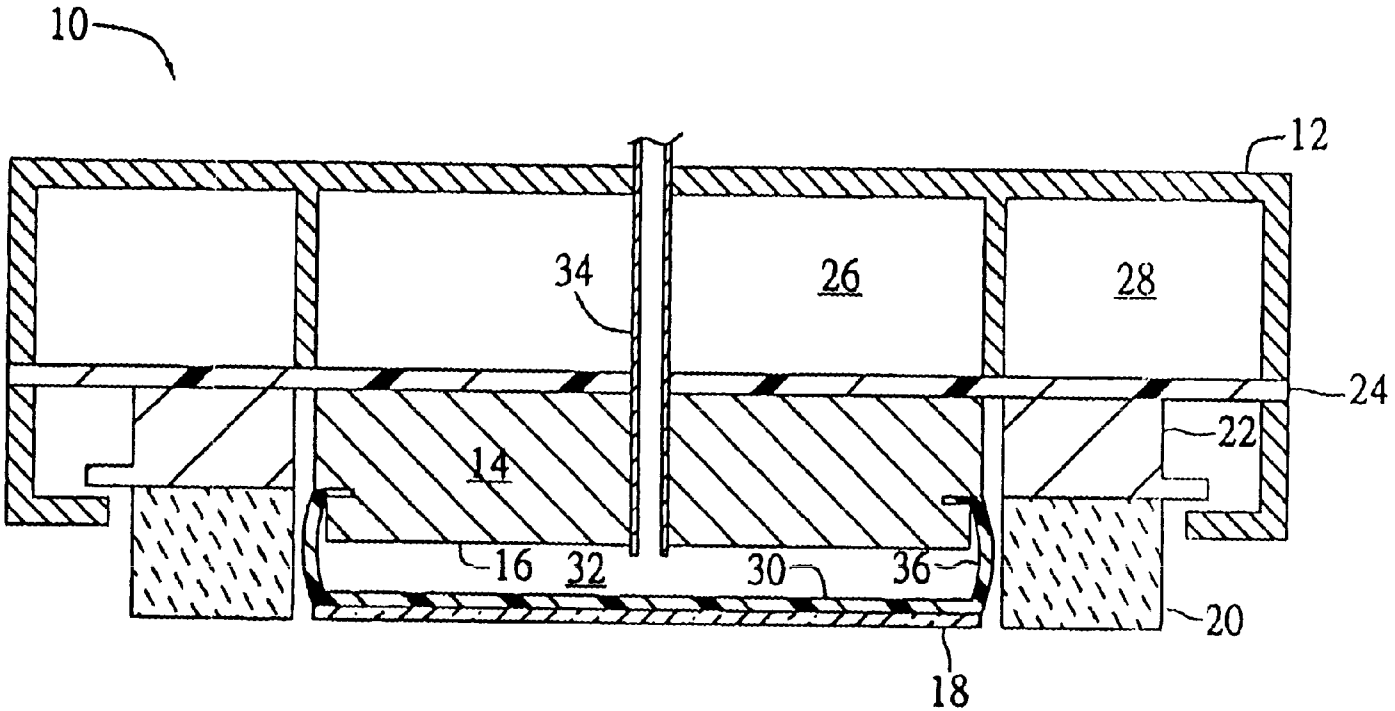
FIG. 1 (Prior Art)
FIG. 1 (prior art) is a diagrammatic illustration showing a cross-sectional side view of a prior art soft-backed polishing head having a flexible member for receiving the substrate thereon.
Figure 2:
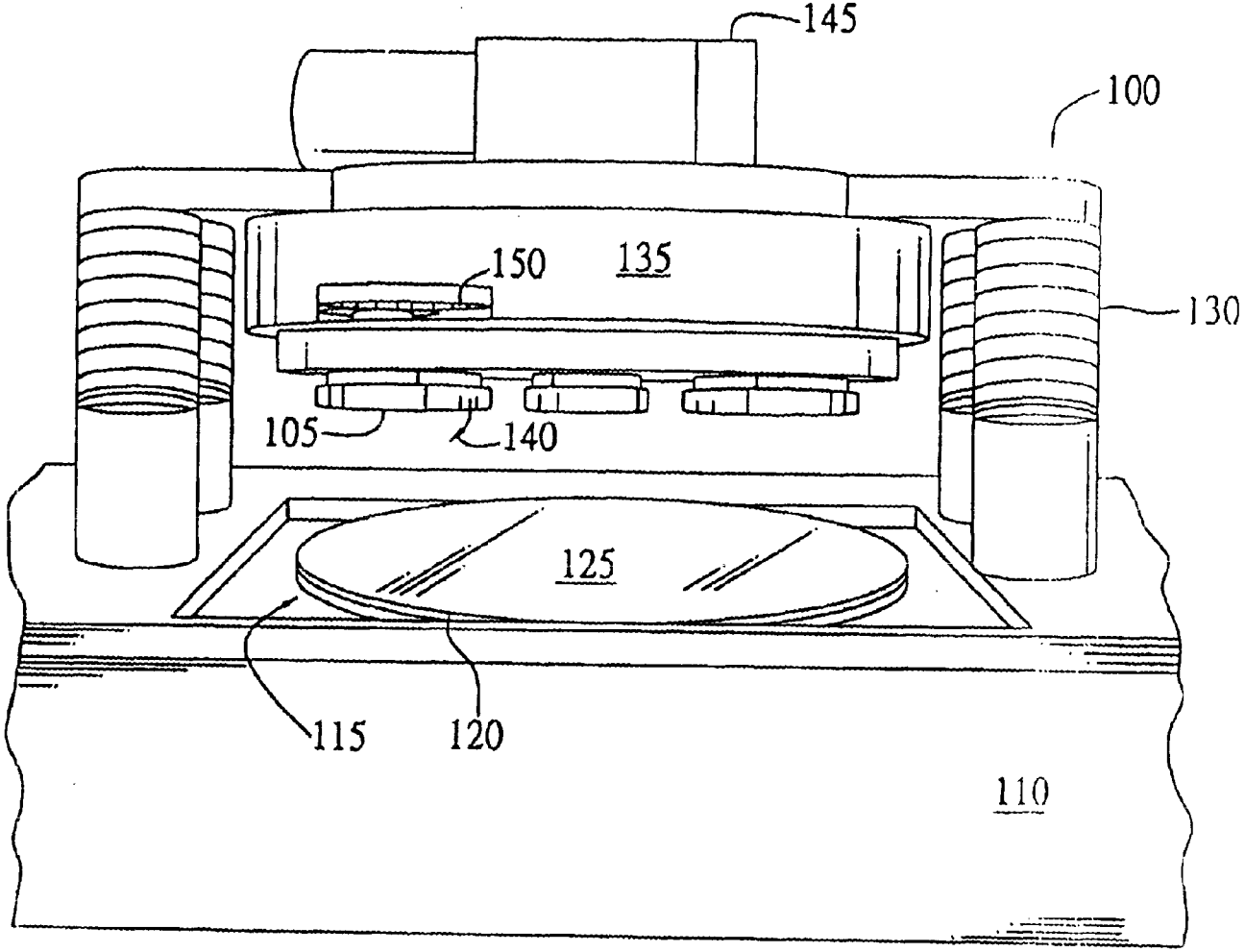
FIG. 2 is a diagrammatic illustration showing an embodiment of an exemplary multi-head polishing or planarization apparatus.

Referring to FIG. 2, there is shown an embodiment of a chemical mechanical polishing or planarization (CMP) apparatus 100 for polishing substrates 105. As used here the term "polishing" means either polishing or planarization of substrates 105, including substrates used in flat panel displays, solar cells and, in particular, semiconductor substrates or wafers on which electronic circuit elements have been or will be formed. Semiconductor wafers are typically thin and fragile disks having diameters nominally between 100 mm and 300 mm. Currently 100 mm, 200 mm, and 300 semiconductor wafers are widely used in the industry. The inventive method and apparatus 100 are applicable to semiconductor wafers and other substrates 105 at least up to 300 mm diameter as well as to larger diameter substrates.

For purposes of clarity, many of the details of the CMP apparatus 100 that are widely known and are not relevant to the present invention have been omitted. CMP apparatuses 100 are described in more detail in, for example, in commonly assigned, co-pending U.S. patent application Ser. No. 09/570,370, filed May 12, 2000 and entitled System and Method for Pneumatic Diaphragm CMP Head Having Separate Retaining Ring and Multi-Region Wafer Pressure Control; Ser. No. 09/570,369, filed May 12, 2000 and entitled System and Method for CMP Having Multi-Pressure Zone Loading For Improved Edge and Annular Zone Material Removal Control; and U.S. Provisional Application Serial No. 60/204,212, filed May 12, 2000 and entitled System and Method for CMP Having Multi-Pressure Annular Zone Subcarrier Material Removal Control, each of which is incorporated herein by reference in its entirety.

The CMP apparatus 100 includes a base 110 rotatably supporting a large rotatable platen 115 with a polishing pad 120 mounted thereto, the polishing pad having a polishing surface 125 on which the substrate 105 is polished. The polishing pad 120 is typically a polyurethane material, such as that available from RODEL of Newark Del. Additionally, a number of recesses (not shown in FIG. 2), such as grooves or cavities, may be provided in the polishing surface 125 to distribute a chemical or slurry between
the polishing surface and a surface of a substrate 105 placed thereon. By slurry it is meant a chemically active liquid having an abrasive material suspended therein that is used to enhance the rate at which material is removed from the substrate surface. Typically, the slurry is chemically active with at least one material on the substrate 105 and has a pH of approximately 4 to 11. For example, one suitable slurry consists of approximately 12% abrasive and 1% oxidizer in a water base, and includes a colloidal silica or alumina having a particle size of approximately 100 nm. Optionally, as an alternative or in addition to the slurry, the polishing surface 125 of the polishing pad 120 can have a fixed abrasive material embedded therein, such as polishing pads commercially available from Minnesota Mining and Manufacturing Company. In embodiments of CMP apparatuses 100 having a polishing surface 125 with a fixed abrasive, the chemical dispensed onto the polishing surface during polishing operations can be water.

The base 110 also supports a bridge 130 that in turn supports a carousel 135 having one or more polishing heads 140 on which substrates 105 are held during a polishing operation. The bridge 130 is designed to permit raising and lowering of the carousel 135 to bring surfaces of substrates 105 held on the polishing heads 140 into contact with the polishing surface 125 during the polishing operation. The particular embodiment of a CMP apparatus 100 shown in FIG. 2 is a multi-head design, meaning that there are a number of polishing heads 140 mounted or attached to the carousel 135; however, single head CMP apparatuses 100 are known, and it is to be understood that the polishing head 140 and method of the present invention can be used with either a multi-head or single-head polishing apparatuses.

In the particular CMP design shown, each of the polishing heads 140 is driven by a single motor 145 that drives a chain 150, which in turn drives each of the polishing heads via the chain and a sprocket mechanism (not shown); however, the invention may be used in embodiments in which each polishing head 140 is rotated with a separate motor and/or by other means than chain and sprocket type drives. In addition to the rotation of the polishing pad 120 and the polishing heads 140, the carousel 135 can be moved to orbit about a fixed central axis of the polishing platen 115 to provide an orbital motion to the polishing heads. Furthermore, the inventive polishing head 140 may be utilized in all manner of CMP apparatuses 100 including machines utilizing a linear or reciprocating motion as are well known in the art.

The CMP apparatus 100 also incorporates a chemical dispensing mechanism (not shown in FIG. 2) to dispense a chemical or slurry, as described above, onto the polishing surface 125 during the polishing operation, a controller (not shown) to control the dispensing of the slurry and movement of the polishing heads 140 on the polishing surface, and a rotary union (not shown) to provide a number of different fluid channels to communicate pressurized fluids such as air, water, vacuum, or the like between stationary sources external to the polishing head and locations on or within the polishing head.

Figure 3:
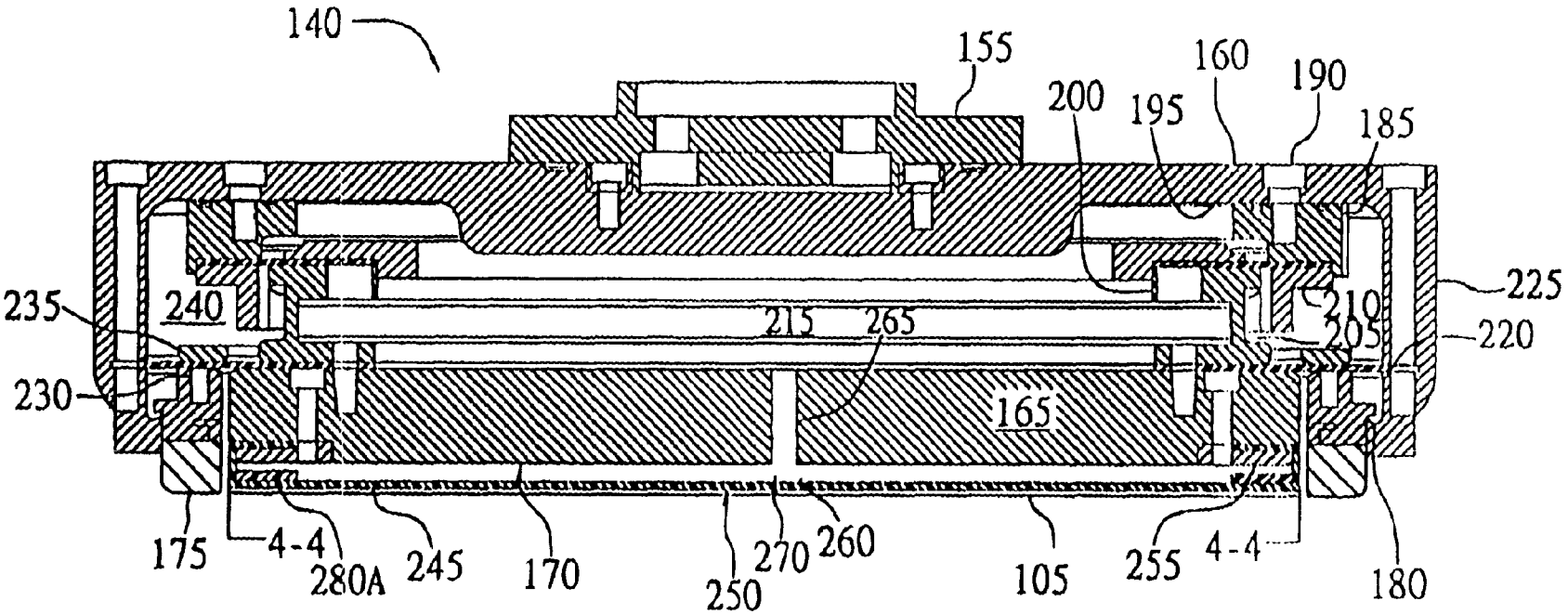
FIG. 3 is a diagrammatic illustration showing a cross-sectional side view of a polishing head according to an embodiment of the present invention.

An embodiment of a polishing head 140 according to the present invention will now be described with reference to FIG. 3. Referring to FIG. 3, the polishing head 140 includes a head mounting assembly 155 for attaching the polishing head to the carousel 135 and a carrier 160 for holding and positioning the substrate 105 on the polishing surface 125 during the polishing operation. The carrier 160 typically includes a subcarrier 165 having a lower surface 170, and a retaining ring 175 circumferentially disposed about a portion of the subcarrier.

The subcarrier 165 and the retaining ring 175, through a backing ring 180, are suspended from the carrier 160 so that they can move vertically with little friction and no binding. Small mechanical tolerances are provided between the subcarrier 165 and the retaining ring 175 and adjacent elements so that they are able to float on the polishing surface 125 in a manner that accommodates both small vertical movements and minor angular variations during the polishing operation. Referring to FIG. 3, a flange 185 attaches via screws 190 or other fasteners to an inner lower surface 195 of the carrier 160. The flange 185 is joined via a first flexible membrane or gasket 200 to an inner support ring 205 and an outer support ring 210 to flexibly support the subcarrier 165 and define a closed chamber or cavity 215 above the subcarrier 165. The retaining ring 175 is supported by a second flexible membrane or gasket 220 extending between the subcarrier 165 and a skirt portion 225 of the carrier 160. The retaining ring 175 can be coupled to the second gasket 220, via the backing ring 180, using an adhesive (not shown), or using screws 230 or other fasteners that attach to a backing plate 235 on the opposite side of the gasket, as shown in FIG. 2. The flange 185, lower skirt portion 225, the inner and outer support rings 205, 210, and the second gasket 220 form a second closed cavity 240 above the retaining ring 175.

In operation, the subcarrier 165 and the retaining ring 175 are independently biased or pressed against the polishing surface 125 while providing a slurry and relative motion between the substrate 105 and the polishing surface 125 to polish the substrate. The biasing force can be provided by springs (not shown) or by the weight of the subcarrier 165 and the retaining ring 175 themselves. Preferably, as shown in FIG. 2, the subcarrier 165 and the retaining ring 175 are pressed against the polishing surface 125 by a pressurized fluid introduced into closed cavities or chambers 215, 240, above the subcarrier 165 and the retaining ring 175 respectively. The use of a pressurized fluid is preferred since the application of the force is more uniform and more readily altered to adjust the polishing or removal rate. Generally, the pressure applied is in the range of between about 4.5 and 5.5 psi, more typically about 5 psi. However, these ranges are only exemplary as any of the pressures may be adjusted to achieve the desired polishing or planarization effects over a range from about 2 psi and about 8 psi. More preferably, the biasing force or pressure applied to the retaining ring 175 is greater than that applied to the subcarrier 165 to slightly deform the polishing surface 125 thereby reducing the so-called edge effect, and thereby provide a more uniform rate of removal and planarization across the surface of the substrate 105. The edge effect refers to the tendency for the rate of removal to be greater at the edge of the substrate 105 than at a central portion due to the interaction of the polishing surface 125 with the edge of the substrate. By pressing down on and slightly deforming the polishing surface 125 near the edge of the substrate 105 the retaining ring 175 reduces the force with which the edge of the substrate is pressed against the polishing surface, thereby lowering the local removal rate to a level more nearly equal to that of other areas across the substrate surface.

Figure 4:
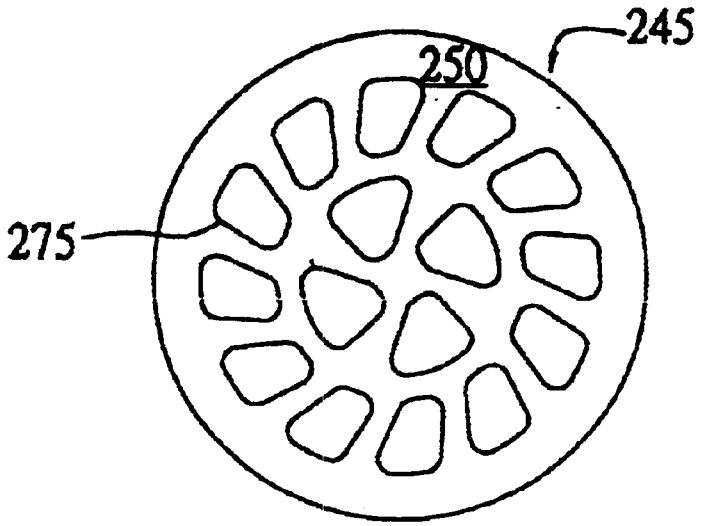
FIG. 4 is a plan view of a portion of the polishing head of FIG. 3 taken along the line 4—4 of FIG. 3 showing an embodiment of a flexible member according to the present invention.

In accordance with the present invention, the subcarrier 165 can include on the lower surface 170 a soft insert, such as flexible member 245 or membrane stretched over the lower surface 170 of the subcarrier 165, and having a receiving surface 250 on which the substrate 105 is received. The flexible member 245 has a thickness having a plurality of openings or holes (not shown in this figure) extending through the thickness to the receiving surface 250 to apply a pressurized fluid, at least in part, directly against a backside of the substrate 105 to press the substrate directly against the polishing surface 125. Generally, the pressure applied is also in the range of between about 2 and 8 psi, more typically about 5 psi. Preferably, the number and size of the holes is selected to maximize the area of the substrate 105 exposed directly to the pressurized fluid while providing a sufficient area of the receiving surface 250 in contact with or engaging the substrate 105 to impart torque or rotational energy from the polishing head 140 to the substrate during the polishing operation. The advantages of the flexible member 245 of the present invention include: (i) the ability to reduce or eliminate the impact of particles or impurities caught between the receiving surface 250 and the substrate 105 on polishing uniformity by reducing the area in which such particles could be trapped; (ii) the ability to reduce or eliminate non-uniformities in polishing due to wrinkling of the substrate; and (iii) the ability to reduce or eliminate non-uniformities in polishing due to variation in thickness of the flexible member 245. The flexible member 245 and the holes therein are shown in FIG. 4 and described in greater detail hereinafter.

In accordance with the present invention, the polishing head 140 further includes at least one control-insert 280 disposed between the flexible member 245 and the lower surface 170 to control or tailor the rate of removal of material across the substrate surface to inhibit non-planar polishing of the substrate surface. The control-insert 280 provides localized regions of higher force by mechanically transmitting force applied to the subcarrier 165, directly from the lower surface 170 to the flexible member 245, and through the flexible member to the substrate 105. In general, the control-insert 280 can include either: (i) a continuous disk (not shown in FIG. 3) to control the rate of removal in a region corresponding to a center of the substrate 105; (ii) an annular ring or rings to control the rate of removal near the edge of the substrate (as shown in FIG. 3) or between the edge and the center of the substrate; (iii) or a combination of a disk and an annular ring or rings (not shown in FIG. 3). For example, in the embodiment shown in FIG. 3, the control-insert 280 includes a single annular ring 280A located in a region near an outer circumferential edge 285 of the flexible member 245 to control a rate of removal of material from an area near an outer circumferential edge of the surface of the substrate 105. This embodiment is particularly advantageous for use with CMP processes that typically have a high center removal rate. For example, processes using colloidal silica slurries, versus slurries made from fumed silica particles, or a polishing pad 120 having a softer under layers tend to be edge slow and center fast. Thus, the polishing head having a control-insert 280 according to the present invention can reduce operating cost of the CMP apparatus 100 by reducing the need to stock and different slurries and polishing pads 120 for different polishing operations on different substrates 105.

This embodiment is also advantageous for use with a CMP apparatus 100 having a compliant polishing surface 125 that is deformed during the polishing operation by the retaining ring 175. Although, as explained above, the retaining ring 175 is effective at reducing or eliminating the so-called edge effect, that is the excess removal of material near the edge of the substrate 105 due to the interaction of the edge and the polishing surface 125, it can result in what is commonly know as a rebound effect. The rebound effect refers to separation of the polishing surface 125 from the surface of the outer edge of the substrate 105 and the resultant reduction in polishing force that occurs due to the polishing pad 120 deforming under pressure of the retaining ring 175. Thus, in the embodiment shown in FIG. 3, the control-insert 280 provides additional mechanical force in the region near the edge of the substrate 105 to compensate for the rebound effect, thereby providing a more uniform total force across the surface of the substrate resulting in a more planar polishing across the surface of the substrate.

Although shown as a separate element in FIG. 3 for purposes of clarity, it should be noted that the control-insert 280 can, and in certain preferred embodiments is, integrally formed with the flexible member 245, as described in greater detail herein.

In general, both the control-insert 280 and the control-insert 280 are made from a polymeric material, preferably from a pliant or flexible rubber or rubber-like material, such as EPDM, EPR, silcone, FKM or CR. A pliant material is preferred to enable the flexible member 245 conform to the substrate 105, and to enable the control-insert 280 to conform to the lower surface 170 of the subcarrier 165 and to more evenly distribute force to the substrate. In addition, the flexible member 245 is typically made from a polymeric material which is non-reactive with the substrate 105 and chemicals used in the polishing operation.

The flexible member 245 is separated from and attached to the lower surface 170 of the subcarrier 165 by a support assembly 255 to form a lower pressure chamber or cavity 260 defined by the lower surface 170 of the subcarrier 165, the support assembly, the flexible member and the backside of a substrate 105 held on the receiving surface 250 of the flexible member. Pressurized fluid, such as air or another gas, is introduced into the lower cavity 260 through a passageway 265 connected to a port 270 in the lower surface 170 of the subcarrier 165. The support assembly 255 is generally made from a non-compressible or substantially non-compressible material such as metal, hard polymeric material, or the like.

Referring to FIG. 4, a plan view of the receiving surface 250 of the flexible member 245 according to an embodiment of the invention is shown. In this figure a number of holes 275 spaced regularly and symmetrically across the receiving surface 250 is shown. As noted above, the number and size of the holes 275 is selected to provide a sufficient area of the receiving surface 250 in contact with the substrate 105 to impart torque or rotational energy from the polishing head 140 to the substrate to cause the substrate to rotate during the polishing operation. It has been found that a receiving surface having a surface area wherein the total area of the holes 275 is from about 50 to about 90 percent of the surface area, and more preferably from about 66 to about 75 percent of the surface area provides sufficient engagement. In a preferred embodiment, the holes 275 can have an edge angled in relation to the direction of rotation of the polishing head 140 to stiffen the flexible member 245 to increase engagement between the flexible member and the substrate 105, thereby providing increased torque. For example, holes 275 having the shape shown in FIG. 4 would provide increased engagement when the polishing head is rotated in the clockwise direction.

The flexible member 245 provides a soft receiving surface 250 to the substrate 105 and a more homogeneous distribution of pressure or force across the substrate during the polishing operation. However, due to deformation and rebound of the polishing surface 125 or a surface topography of the substrate 105, some areas or regions of the surface of the substrate can experience a higher or lower force leading to non-planar polishing of the substrate surface. In addition, it may be desirable to provide regions of higher or lower force to compensate for areas of the substrate 105 consisting largely or entirely of materials having a higher or lower removal rate than other areas.

Figure 5A:
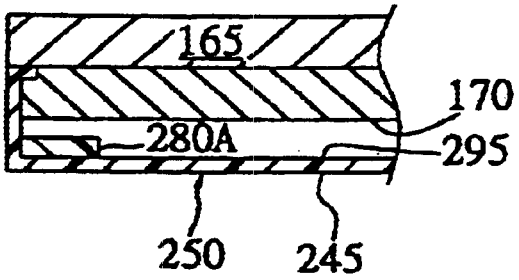
FIG. 5A is a diagrammatic illustration showing a partial cross-sectional side view of a polishing head having a closed lower cavity showing a control-insert according to an embodiment of the present invention.
Figure 5B:
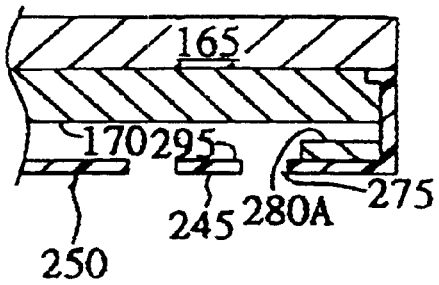
FIG. 5B is a diagrammatic illustration showing a partial cross-sectional side view of a polishing head having an open lower cavity showing a control-insert similar to that in 5A according to an alternative embodiment of the present invention.

The control-insert 280 of the polishing head 140 of FIG. 3 is illustrated in more detail in FIGS. 5A and 5B. Referring to FIG. 5A, the control-insert 280 is a flat annular ring 280A, having a substantially constant or uniform cross-sectional thickness. The polishing head 140 shown in FIG. 5A has a closed lower cavity 260 in which the flexible member 245 does not include holes 275 to expose the substrate 105 directly to the pressurized fluid. In an alternative embodiment, shown in FIG. 5B, the polishing head 140 includes a flexible member 245 having holes 275 therein to provide an open lower cavity 260, and a control-insert 280 similar to that in 5A is located and oriented to furnish substantially unimpeded access of the pressurized fluid to the substrate 105.

Figure 6A:
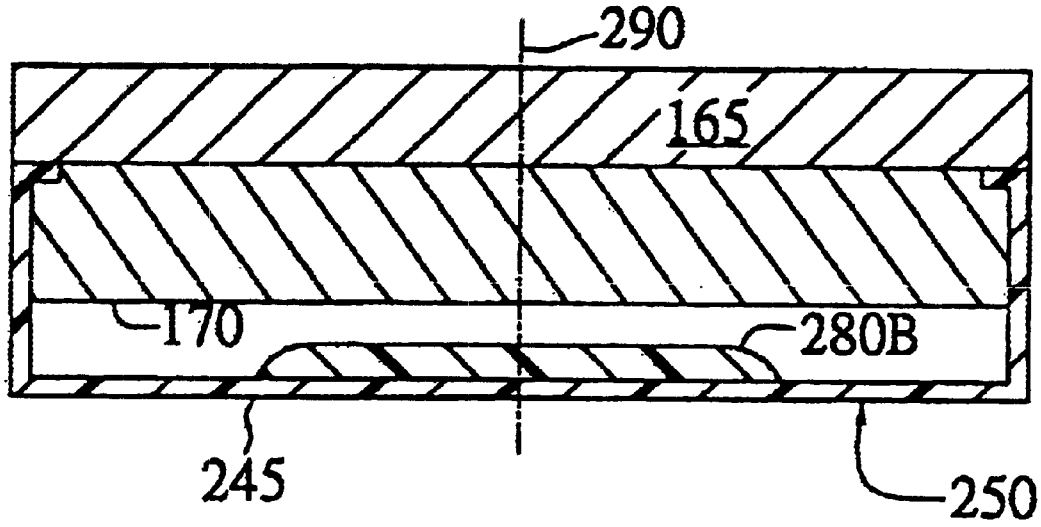
FIG. 6A is a diagrammatic illustration showing a cross-sectional side view of a polishing head having a closed lower cavity and a disk shaped control-insert according to an embodiment of the present invention.
Figure 6B:
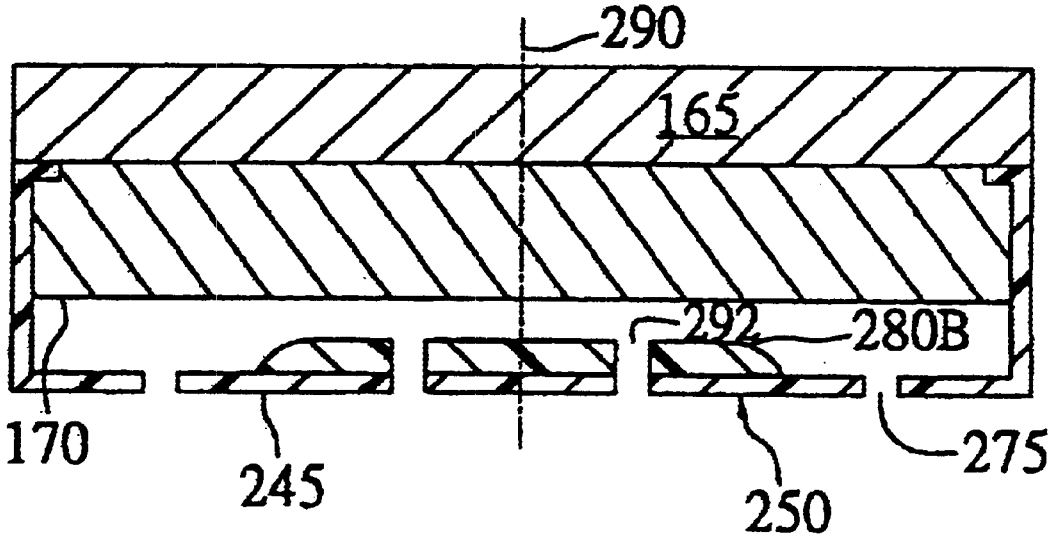
FIG. 6B is a diagrammatic illustration showing a cross-sectional side view of a polishing head having an open lower cavity and a disk shaped control-insert similar to that shown in FIG. 6A according to an alternative embodiment of the present invention.

In an alternative embodiment, shown in FIGS. 6A and 6B, the control-insert 280 is a disk 280B positioned near the center of the flexible member. Preferably, the disk 280B is concentric with the center of the flexible member indicated by line 290. More preferably, the polishing head 140 is designed and sized such that the regions near the center and edge of flexible member 245 correspond to areas near the center and edge of a substrate 105 held on the receiving surface 250 thereof. Thus, this embodiment would provide a higher polishing pressure or force in an area near the center of the substrate 105. This embodiment, can be particularly advantageous for polishing or planarizing non-uniform deposited layers, for example, copper layers, which as explained above tend to form a convex layer thicker at the center of the substrate than the edge.

FIG. 6B illustrates an embodiment of a control-insert 280B similar or identical to that shown in FIG. 6A adapted for use with a polishing head 140 having an open lower cavity 260, as described above. In the version shown in FIG. 6B, the control-insert further includes a number of holes 292 positioned to correspond with the holes 275 in the flexible membrane 245. Generally, the holes 292 in the control-insert 280B are also sized and shaped to correspond with the holes 275 in the flexible membrane 245.

Figure 7A:
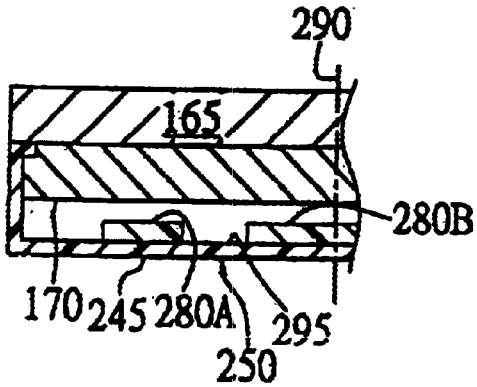
FIG. 7A is a diagrammatic illustration showing a partial cross-sectional side view of a polishing head having a closed lower cavity showing a plurality of control-inserts according to an embodiment of the present invention.
Figure 7B:
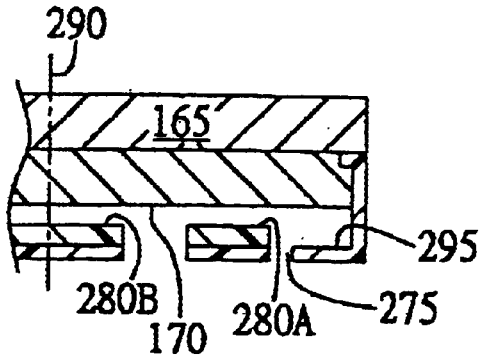
FIG. 7B is a diagrammatic illustration showing a partial cross-sectional side view of a polishing head having an open lower cavity showing control-inserts similar to those in FIG. 7A according to an alternative embodiment of the present invention.

In yet another alternative embodiment, shown in FIGS. 7A and 7B, the control-insert 280 includes both an annular ring 280A located between the outer circumferential edge and the center of the flexible member 245, and a disk 280B positioned near the center of the flexible member. Thus, the embodiment shown would provide higher polishing pressure or force both in an area near the center and in an area between the edge and center of the substrate 105. FIG. 7B illustrates a control-insert 280 similar or identical to that shown in FIG. 7A adapted for use with a polishing head 140 having an open lower cavity 260, as described above.

It is noted that although embodiments of the control-inserts 280 shown heretofore, have a substantially constant and uniform cross-sectional thickness, that need not be the case in every embodiment. To the contrary, in certain applications it is desirable for the control-insert 280 to include annular rings 280A or disk 280B having different or even non-uniform cross-sectional thicknesses to further adjust the removal rate across the surface of the substrate 105. Alternatively, the thickness may be uniform or substantially uniform but be constructed of a composite material or a material whose properties vary radially or according to some other scheme.

Certain exemplary embodiments of control-inserts 280 having profiles with non-uniform cross-sectional thicknesses will now be described with reference to FIGS. 7 to 10.

Figure 8:
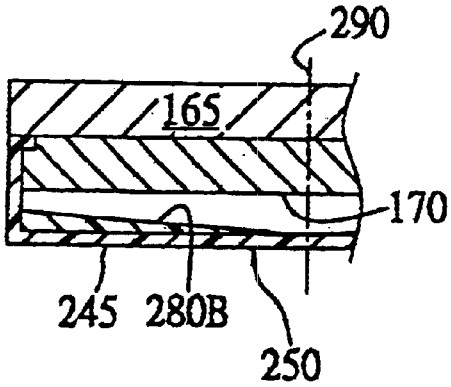
FIG. 8 is a diagrammatic illustration showing a partial cross-sectional side view of a polishing head showing a control-insert having a thickness that linearly increases from the center to the edge of a flexible member according to another alternative embodiment of the present invention.

FIG. 8 is a diagrammatic illustration showing a partial cross-sectional side view of a polishing head 140 having an alternative embodiment of a disk 280B shaped control-insert 280 with a thickness that linearly increases from a point proximal to the center of the flexible member 245 to the outer circumferential edge of the control-insert.

Figure 9:
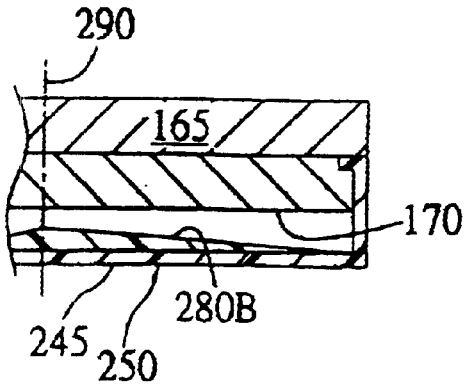
FIG. 9 is a diagrammatic illustration showing a partial cross-sectional side view of a polishing head showing a control-insert having a thickness that linearly decreases from the center to the edge of a flexible member according to yet another alternative embodiment of the present invention.

FIG. 9 is another alternative embodiment of a disk shaped control-insert 280B having a thickness that linearly decreases from a point proximal to the center of the flexible member 245 to the outer circumferential edge of the control-insert.

Figure 10:
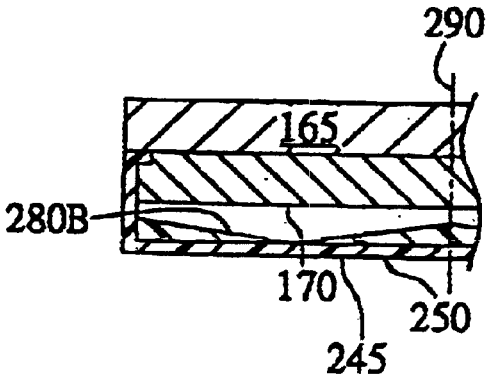
FIG. 10 is a diagrammatic illustration showing a partial cross-sectional side view of a polishing head showing a control-insert having a thickness that decreases then increases from the center to the edge of a flexible member according to still another alternative embodiment of the present invention.

FIG. 10 is yet another alternative embodiment of a disk shaped control 280B insert having a thickness that linearly decreases in a radial direction in a first region from a point proximal to the center of the flexible member 245, and linearly increases in the radial direction in a second region from the first region to the outer circumferential edge of the control-insert.

Figure 11:
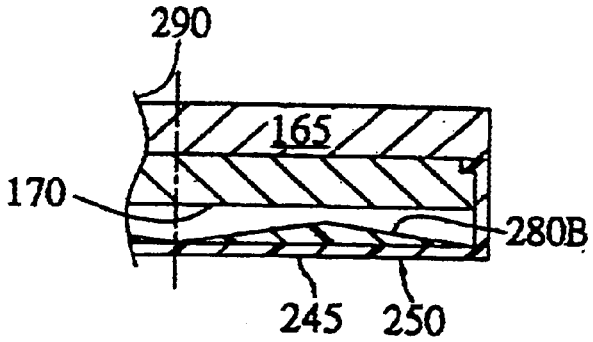
FIG. 11 is a diagrammatic illustration showing a partial cross-sectional side view of a polishing head showing a control-insert having a thickness that increases then decreases from the center to the edge of a flexible member according to another alternative embodiment of the present invention.

FIG. 11 is still another alternative embodiment of a disk shaped control-insert 280B having a thickness that linearly increases in a radial direction in a first region from a point proximal to the center of the flexible member 245, and linearly decreases in the radial direction in a second region from the first region to the outer circumferential edge of the control-insert.

Figure 12:
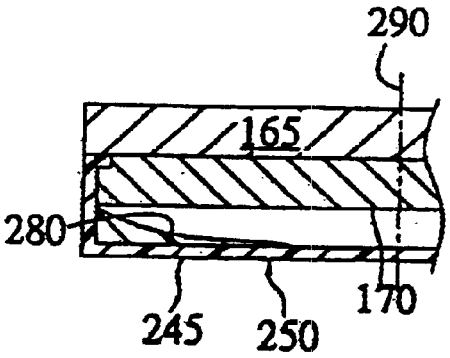
FIG. 12 is a diagrammatic illustration showing a partial cross-sectional side view of a polishing head showing a control-insert having a thickness that increases non-linearly from the center to the edge of a flexible member according to another alternative embodiment of the present invention.
Figure 13:
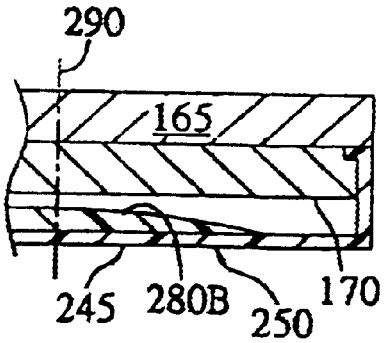
FIG. 13 is a diagrammatic illustration showing a partial cross-sectional side view of a polishing head showing a control-insert having a thickness that decreases non-linearly from the center to the edge of a flexible member according to yet another alternative embodiment of the present invention.

It will be appreciated that while the profiles of the control-inserts 280 in the above embodiments are shown as having cross-sectional thicknesses that increase or decrease linearly, the present invention is not so limited. That is the control-insert 280 can also have profiles with curved cross-sectional thickness that increase and decrease in a non-linear manner, as shown in FIGS. 12 and 13, without departing from the spirit and scope of the present invention.

Similarly, depending on size, location, and material of which it is made the control-insert 280 can be attached either to the lower surface 170 of the subcarrier 165 or to an inner surface 295 of the flexible member 245 without departing from the scope of the invention. Generally, control-insert 280 can be attached either to the lower surface 170 of the subcarrier 165 or to the inner surface 295 of the flexible member 245 by an adhesive or by mechanical fasteners, such as screws or clamps. However, in one alternative embodiment, not shown, the control-insert 280 is an annular ring 280A or a disk 280B having an outer circumference substantially the same as an inner circumference of the flexible member 245, and the control-insert floats within the lower cavity 260.

Preferably, the control-insert is 280 attached to the inner surface 295 of the flexible member 245. More preferably, the control-insert 280 is made of substantially the same material as the flexible member 245 and is integrally formed therewith. This leads to efficiencies in manufacturing and in maintaining the polishing head 140, since the control-insert 280 can be changed or replaced simply by replacing the flexible member 245. It should be noted that although the control-insert 280 is made of substantially the same material and integrally formed with the flexible member 245, the control-insert and flexible member need not have same hardness. One method of accomplishing this is to pre-form either the control-insert 280 or the flexible member 245, and place the pre-formed component in a mold or casting into which polymeric material having a different composition and, consequently, a different hardness is poured to form the remaining component. For example, in one embodiment, the control-insert 280 is preformed from a first polymeric material and placed into a mold for the flexible member 245 into which a second polymeric material, having a different hardness is poured. Alternatively, the one or more of the control-insert 280 or the flexible member 245 can be treated subsequent to being formed or molded to provide a hardness different than that of the other. For example, curing with ultra violet (UV) light can increase cross linking of the rubber and thereby the hardness of the treated component.

The control-insert 280 can have a hardness with a Durometer of from about 15A to about 90A, whereas the flexible member 245 typically has a Durometer of from about 30A to about 60A. Generally, it is desirable that the control-insert 280 has a hardness less than that of the flexible member to provide sufficient flexibility to conform with the lower surface the lower surface 170 of the subcarrier 165 and to provide a more uniform distribution of force across the are of the control-insert. More preferably, the control-insert 280 has a hardness with a Durometer of from about 30A to about 60A and most preferably with a Durometer of less than about 45A.

Figure 14:
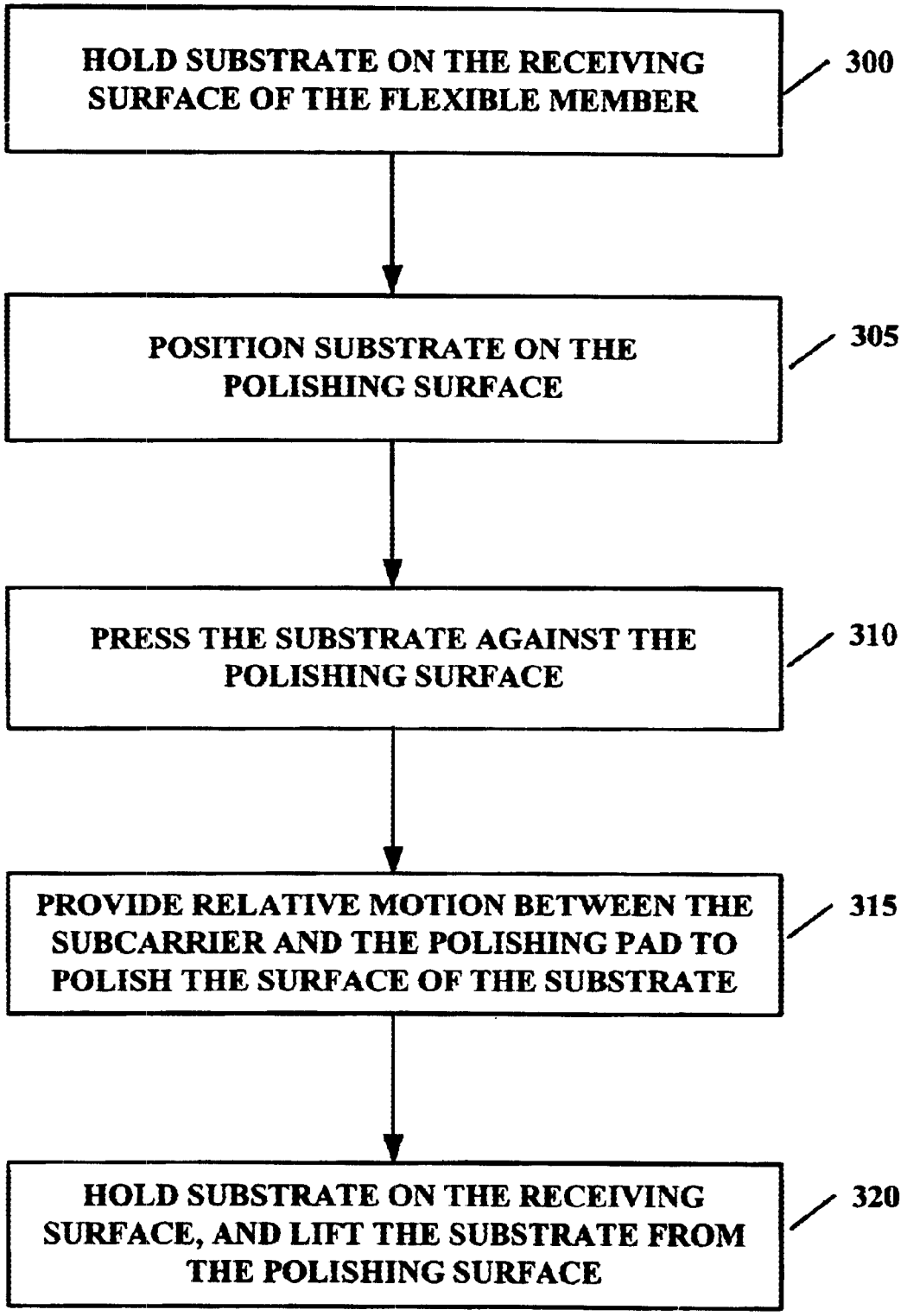
FIG. 14 is a flowchart showing an embodiment of a process for polishing or planarizing a substrate according to an embodiment of the present invention.

An embodiment of a method for operating a CMP apparatus 100 according to the present invention will now be described with reference to FIG. 14. In an initial or loading step a substrate 105 is positioned on the receiving surface 250 of the flexible member 245 (Step 300). Generally, the substrate 105 is held to the receiving surface 250 by vacuum drawn through port 270 in the lower surface 170. The substrate 105 is positioned on the polishing surface 125 (Step 305) and a pressurized fluid introduced into cavities 215, 240, to press the substrate 105 and the retaining ring 175 against the polishing surface 215 (Step 310). Generally, the step of pressing the substrate 105 against the polishing surface 125, step 310, involves admitting the pressurized fluid into the lower cavity 260 to press the substrate against the polishing pad. Preferably, in accordance with the present invention, the step further involves transmitting a mechanical force applied to the subcarrier 165 through the control-insert 280 to various locations across the substrate 105 in addition to that provided by the pressurized fluid. Relative motion between the subcarrier 165 and the polishing pad 125 is provided to polish the surface of the substrate 105 (Step 315). After polishing is complete and rotation of the polishing head 140, and polishing platen 115 is stopped, vacuum is again used to hold the substrate 105 to the receiving surface 250, and the substrate is lifted from the polishing surface 125 (Step 320).

Figure 15:
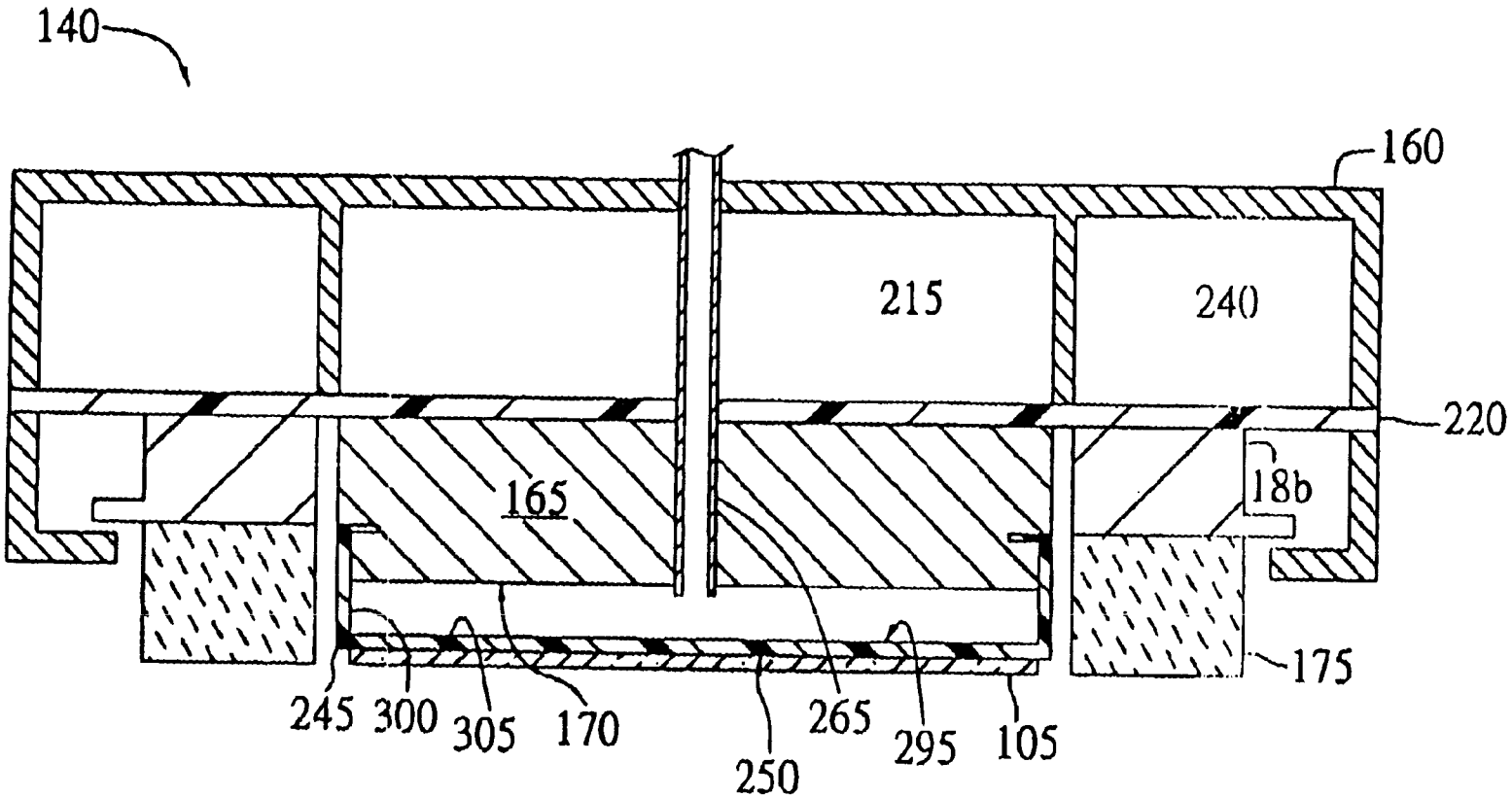
FIG. 15 is a diagrammatic illustration showing a cross-sectional side view of a soft-backed polishing head having a flexible member with a skirt portion and a receiving surface portion made from materials having different hardness according an embodiment of the present invention.

In another aspect, shown in FIG. 15, the present invention is directed to a polishing head 140 having a flexible member 245 with a skirt portion 325 circumferentially about the support assembly 255, the skirt portion made from a material having a hardness different from that of the portion of the flexible member 245 including the receiving surface 250. FIG. 14 is a diagrammatic illustration showing a cross-sectional side view of a soft-backed polishing head 140 having a flexible member 245 with a skirt portion 325 and a receiving surface portion 330 made from materials having different hardness according an embodiment of the present invention. Generally, the skirt portion 325 has a hardness greater than that of the receiving surface portion 330. This is desirable where the polishing head 140 includes a carrier 160 and a retaining ring 175 circumferentially disposed about the subcarrier 165. In this embodiment, the skirt portion 325 of the flexible member should be sufficiently hard to prevent it from deforming during the polishing operation and touching the retaining ring 175. Preferably, the skirt portion 325 has a hardness at least about 50% higher than the receiving surface portion 330. More preferably, the where receiving surface portion 330 has a Durometer of from about 30A to about 60A, and the skirt portion 325 has a Durometer of from about 60A to about 90A. Most preferably, where the receiving surface portion 330 has a hardness with a Durometer of less than about 50A, the skirt portion 325 has a hardness with a Durometer of at least about 70A.

The skirt portion 325 can fabricated separately from the receiving surface portion 330, and joined to it later using, for example, an adhesive or a reflow process in which the assembled portions 325, 330, are heated to soften the material along their interface, enabling the formation of a bond therebetween. Alternatively, the skirt and receiving surface portions 325, 330, are integrally formed from the same material. As with the control-insert 280 above, the skirt portion 325 can be integrally molded with the receiving surface portion 330 from a rubber or rubber-like material having a different composition and, consequently, a different hardness. Alternatively, the skirt portion 325 can be treated after the flexible member 245 is formed to provide a hardness different from that of the receiving surface portion.

In another alternative embodiment of this aspect, the skirt and receiving surface portions 325, 330, are integrally formed from the same material having the same hardness, and it is the radial thickness of the skirt portion that is varied to provide a greater stiffness to the skirt portion, thereby enabling it to resist deformation and bowing. This embodiment, can be advantageous when combined with an annular control-insert 280A integrally formed with the flexible member 245. That is the flexible member 245 can be molded to have a thicker skirt portion 325 and a thicker ring of material around the outer circumference of the receiving surface portion 330 to efficiently and integrally form the control-insert 280A. Preferably, the skirt portion 325 has a thickness of from about 20 to about 70 percent greater than that of the receiving surface portion 330. More preferably, the skirt portion 325 has a thickness of at least about 50 percent greater than that of the receiving surface portion 330. Thus, for a flexible member 245 having a receiving surface portion 330 with a thickness of from about 0.3 mm to about 3 mm, the skirt portion 325 generally has a thickness of from about 1 mm to about 30 mm. It will be appreciated that the precise thicknesses depend inter alia on the overall diameter of the flexible member 245. That is a flexible member 245 sized to accommodate a substrate 105 having a diameter of 100 mm will generally be thinner than one designed for 200 mm or 300 mm substrates.

It is to be understood that even though numerous characteristics and advantages of certain embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A polishing head for positioning a substrate having a surface on a polishing pad of a polishing apparatus, the polishing head comprising:

a subcarrier adapted to hold the substrate during a polishing operation, the subcarrier having a lower surface;

a flexible member secured to the subcarrier and extending substantially across the lower surface thereof, the flexible member having:

a receiving surface adapted to contact the substrate so as to press the substrate against the polishing pad;

an inner surface in facing opposition with the lower surface of the subcarrier; and a control-insert attached to the inner surface, the control-insert integrally formed with the flexible member and comprising an annular ring adapted to provide a variable rate of removal of material across the surface of the substrate, whereby non-planar polishing of the surface of the substrate is inhibited.

2. A polishing head according to claim 1, wherein the control-insert is made of a polymeric material.

3. A polishing head according to claim 1, wherein the control-insert is made of substantially the same material as the flexible member.

4. A polishing head according to claim 1, wherein the control-insert is located near an outer circumferential edge of the flexible member to control a rate of removal of material from an outer circumferential edge of the surface of the substrate.

5. A polishing head according to claim 1, wherein the control-insert is located between an outer circumferential edge of the flexible member and a center of the flexible member to control a rate of removal of material from an annular middle portion of the surface of the substrate between an outer circumferential edge of the surface of the substrate and a center of the surface of the substrate.

6. A polishing head according to claim 1, wherein the subcarrier further comprises a passageway in communication with the lower surface for providing a pressurized fluid to a chamber defined by the flexible member and the lower surface of the subcarrier, and wherein the flexible member has a thickness having a plurality of holes extending therethrough to the receiving surface for applying the pressurized fluid directly to the substrate.

7. A polishing head according to claim 6, wherein the control-insert is located in a position relative to the plurality of holes to enable the pressurized fluid to be applied directly to the substrate.

8. A polishing head according to claim 1, wherein the control-insert comprises a plurality of annular rings.

9. A polishing head according to claim 1, wherein the control-insert further comprises a disk.

10. A polishing head according to claim 1, wherein the flexible member is spaced apart from the lower surface by a support assembly disposed between the flexible member and the lower surface, arid wherein the flexible member further comprises a skirt portion disposed circumferentially about the support assembly.

11. A polishing head according to claim 10, wherein the skirt portion comprises a hardness greater that that of the receiving surface.

12. A polishing head according to claim 10, further comprising a carrier and a retaining ring, the carrier adapted to carry the subcarrier, the retaining ring circumferentially disposed about the subcarrier, and wherein the skirt portion comprises a hardness sufficiently hard to substantially prevent the skirt portion of the flexible member from deforming during the polishing operation and contacting the retaining ring.

13. A polishing head according to claim 12, wherein skirt portion comprises a hardness at least about 50% higher than the receiving surface.

14. A polishing head according to claim 13, wherein skirt portion comprises a hardness with a Durometer of at least about 70A.

15. A polishing head according to claim 13, wherein receiving surface comprises a hardness with a Durometer of less than about 50A.

16. A method of polishing a surface of a substrate using an apparatus comprising a polishing pad, a polishing head having a subcarrier with a lower surface, a flexible member extending substantially across the lower surface, the flexible member having a receiving surface adapted to hold the substrate so as to press the substrate against the polishing pad, the flexible membrane including an inner surface in facing opposition with the lower surface of the subcarrier, and wherein the flexible membrane has a control-insert integrally formed therewith, the control insert comprising an annular ring, the method comprising steps of:

positioning the substrate on the receiving surface of the flexible member;

pressing the surface of the substrate against the polishing pad to provide a variable rate of removal of material across the surface of the substrate by transmitting a mechanical force applied to the subcarrier through the control-insert to an annular ring shaped area across the substrate; and providing relative motion between the subcarrier and the polishing pad to polish the surface of the substrate, whereby non-planar polishing of the surface of the substrate is inhibited.

17. A method according claim 16, wherein the subcarrier further comprises a passageway in communication with the lower surface for providing a pressurized fluid to a chamber defined by the flexible member and the lower surface of the subcarrier, and wherein the flexible member has a thickness having a plurality of holes extending therethrough to the receiving surface, and wherein the step of pressing the surface of the substrate against the polishing pad comprises the step of for admitting the pressurized fluid into the chamber to press the substrate against the polishing pad.

18. A method according claim 16, wherein the annular ring is located near an outer circumferential edge of the flexible member, and wherein the step of pressing the surface of the substrate against the polishing pad to provide a variable rate of removal of material across the surface of the substrate comprises the step of providing a rate of removal of material from an outer circumferential edge of the surface of the substrate higher than from a center of the substrate.

19. A substrate having a surface polished according to the method of claim 16.

20. A method according claim 16, wherein the annular ring is located between an outer circumferential edge of the flexible member and a center of the flexible member, and wherein the step of pressing the surface of the substrate against the polishing pad to provide a variable rate of removal of material across the surface of the substrate comprises the step of providing a rate of removal of material from an annular middle portion of the surface of the substrate between an outer circumferential edge of the surface of the substrate and a center of the surface of the substrate higher than from the center of the surface of the substrate and the edge of the surface of the substrate.

21. A polishing head for positioning a substrate having a surface on a polishing pad of a polishing apparatus, the polishing head comprising:

a subcarrier adapted to hold the substrate during a polishing operation, the subcarrier having a lower surface;

a flexible member secured to the subcarrier and extending substantially across the lower surface thereof, the flexible member having:

a receiving surface adapted to contact the substrate so as to press the substrate against the polishing pad;

an inner surface in facing opposition with the lower surface of the subcarrier; and a control-insert attached to the inner surface, the control-insert comprising a thickness that increases from a point proximal to a center of the flexible member to an outer circumferential edge of the control-insert to provide a variable rate of removal of material across the surface of the substrate, whereby non-planar polishing of the surface of the substrate is inhibited.

22. A polishing head for positioning a substrate having a surface on a polishing pad of a polishing apparatus, the polishing head comprising:

a subcarrier adapted to hold the substrate during a polishing operation, the subcarrier having a lower surface;

a flexible member secured to the subcarrier and extending substantially across the lower surface thereof, the flexible member having:

a receiving surface adapted to contact the substrate so as to press the substrate against the polishing pad;

an inner surface in facing opposition with the lower surface of the subcarrier; and a control-insert attached to the inner surface, the control-insert comprising a thickness that decreases from a point proximal to a center of the flexible member to an outer circumferential edge of the control-insert to provide a variable rate of removal of material across the surface of the substrate, whereby non-planar polishing of the surface of the substrate is inhibited.

23. A polishing head for positioning a substrate having a surface on a polishing pad of a polishing apparatus, the polishing head comprising:

a subcarrier adapted to hold the substrate during a polishing operation, the subcarrier having a lower surface;

a flexible member secured to the subcarrier and extending substantially across the lower surface thereof, the flexible member having a receiving surface adapted to contact the substrate so as to press the substrate against the polishing pad, and an inner surface in facing opposition with the lower surface of the subcarrier;

a control-insert attached to the inner surface, the control-insert comprising a cross-sectional area having a non-uniform thickness across the receiving surface of the flexible member to provide a variable rate of removal of material across the surface of the substrate; and wherein the subcarrier further comprises a passageway in communication with the lower surface for providing a pressurized fluid to a chamber defined by the flexible member and the lower surface of the subcarrier, and wherein the flexible member has a thickness having a plurality of holes extending therethrough to the receiving surface for applying the pressurized fluid directly to the substrate; and wherein the control-insert comprises a disk, and wherein the control-insert includes a second plurality of holes located in a position relative to the plurality of holes in the flexible member to enable the pressurized fluid to be applied directly to the substrate whereby non-planar polishing of the surface of the substrate is inhibited.

24. A method of polishing a surface of a substrate using an apparatus comprising a polishing pad, a polishing head having a subcarrier with a lower surface, a flexible member extending substantially across the lower surface, the flexible member having a receiving surface adapted to hold the substrate so as to press the substrate against the polishing pad, and a control-insert disposed between the flexible member and the lower surface, the control-insert comprises a thickness that increases from a point proximal to a center of the flexible member to an outer circumferential edge of the control-insert, the method comprising steps of:

positioning the substrate on the receiving surface of the flexible member;

pressing the surface of the substrate against the polishing pad to provide a rate of removal of material from an outer circumferential edge of the surface of the substrate higher than from a center of the substrate; and providing relative motion between the subcarrier and the polishing pad to polish the surface of the substrate, whereby non-planar polishing of the surface of the substrate is inhibited.

25. A method of polishing a surface of a substrate using an apparatus comprising a polishing pad, a polishing head having a subcarrier with a lower surface, a flexible member extending substantially across the lower surface, the flexible member having a receiving surface adapted to hold the substrate so as to press the substrate against the polishing pad, and a control-insert disposed between the flexible member and the lower surface, the control-insert comprises a thickness that decreases from a point proximal to a center of the flexible member to an outer circumferential edge of the control-insert, the method comprising steps of:

positioning the substrate on the receiving surface of the flexible member;

pressing the surface of the substrate against the polishing pad to provide a rate of removal of material from a center of the surface of the substrate higher than from an outer circumferential edge of the substrate; and providing relative motion between the subcarrier and the polishing pad to polish the surface of the substrate, whereby non-planar polishing of the surface of the substrate is inhibited.

26. A polishing head for positioning a substrate having a surface on a polishing pad of a polishing apparatus, the polishing head comprising:

a subcarrier adapted to hold the substrate during a polishing operation, the subcarrier having a lower surface;

a flexible member secured to the subcarrier and extending substantially across the lower surface thereof, the flexible member having:

a receiving surface adapted to contact the substrate so as to press the substrate against the polishing pad;

an inner surface in facing opposition with the lower surface of the subcarrier; and a control-insert attached to the inner surface, the control-insert comprising an annular ring having a cross-sectional area with a non-uniform thickness across the receiving surface of the flexible member to provide a variable rate of removal of material across the surface of the substrate, whereby non-planar polishing of the surface of the substrate is inhibited.

27. A method of polishing a surface of a substrate using an apparatus comprising a polishing pad, a polishing head having a subcarrier with a lower surface, a flexible member extending substantially across the lower surface, the flexible member having a receiving surface adapted to hold the substrate so as to press the substrate against the polishing pad, and an inner surface with a control-insert comprising an annular ring attached thereto, the control-insert having a cross-sectional area with a non-uniform thickness across the receiving surface of the flexible member, the method comprising steps of:

positioning the substrate on the receiving surface of the flexible member;

pressing the surface of the substrate against the polishing pad to provide a variable rate of removal of material across the surface of the substrate by transmitting a mechanical force applied to the subcarrier through the control-insert to various locations across the substrate; and providing relative motion between the subcarrier and the polishing pad to polish the surface of the substrate, whereby non-planar polishing of the surface of the substrate is inhibited.

* * * * *